US007303074B2

(12) United States Patent
Dombrowski et al.

(10) Patent No.: US 7,303,074 B2
(45) Date of Patent: Dec. 4, 2007

(54) FOLDABLE ORGANIZER DEVICE

(76) Inventors: Trudy M. Dombrowski, 1821 Wescott Dr., Raleigh, NC (US) 27614; Randall P. Dombrowski, 1821 Wescott Dr., Raleigh, NC (US) 27614

( * ) Notice: Subject to any disclaimer, the term of this patent is extended or adjusted under 35 U.S.C. 154(b) by 425 days.

(21) Appl. No.: 10/946,659

(22) Filed: Sep. 22, 2004

(65) Prior Publication Data

US 2006/0060487 A1 Mar. 23, 2006

(51) Int. Cl.
*B65D 85/48* (2006.01)

(52) U.S. Cl. ..... 206/449; 206/232; 150/148

(58) Field of Classification Search ..... 150/135, 150/138, 147, 148; 206/449, 232, 450; 281/30
See application file for complete search history.

(56) References Cited

U.S. PATENT DOCUMENTS

| | | | | |
|---|---|---|---|---|
| 1,545,577 | A * | 7/1925 | Arms | 150/147 |
| 2,520,176 | A | 8/1950 | Stanley | |
| 2,540,422 | A * | 2/1951 | Broughton | 281/50 |
| 3,267,980 | A * | 8/1966 | Bird | 150/135 |
| 3,565,148 | A * | 2/1971 | Willowdale | 150/147 |
| 4,004,690 | A * | 1/1977 | Giarritta | 206/425 |
| 4,630,843 | A | 12/1986 | Willat | |
| 4,716,948 | A | 1/1988 | Brissette | |
| 4,741,372 | A | 5/1988 | Santilli | |
| 4,832,372 | A * | 5/1989 | Young | 281/31 |
| 4,907,634 | A | 3/1990 | Yoo | |
| 5,230,627 | A * | 7/1993 | Todd | 434/109 |
| 5,333,908 | A | 8/1994 | Dorney et al. | |
| 5,348,347 | A | 9/1994 | Shink | |
| 5,494,366 | A | 2/1996 | Pell et al. | |
| 5,601,681 | A * | 2/1997 | Bayro | 156/268 |
| 5,775,398 | A * | 7/1998 | Siegel | 150/139 |
| 6,017,062 | A | 1/2000 | White | |
| 6,578,706 | B2 | 6/2003 | Thompson | |
| 2003/0209903 | A1 | 11/2003 | Morris | |

OTHER PUBLICATIONS

International Preliminary Report on Patentability for PCT/US05/31134 dated Apr. 5, 2007.

* cited by examiner

*Primary Examiner*—David T. Fidei
(74) *Attorney, Agent, or Firm*—Jenkins, Wilson, Taylor & Hunt, P.A.

(57) ABSTRACT

A foldable device for carrying and displaying at least one flat article is disclosed, including a foldable unitary member adapted for movement between an open and a closed position. The unitary member includes an inside surface, an outside surface, and top, bottom, left and right side edges and further includes a latitudinal fold located between the top side edge and the bottom side edge for separating the unitary member into upper and lower portions and a longitudinal fold located between the left side edge and the right side edge for separating the unitary member into left and right portions. The lower portion of the unitary member is folded onto the upper portion, and the left portion is folded onto the right portion when the unitary member is in the closed position and the unitary member in such a closed position is approximately one quarter of the size of the unitary member in the open position. The foldable device further includes at least one flat article retaining member located on the inside surface of the unitary member for releasably retaining the at least one flat article.

34 Claims, 6 Drawing Sheets

FOLDABLE ORGANIZER DEVICE

TECHNICAL FIELD

The subject matter disclosed herein relates generally to organizers of information. More particularly, the present subject matter relates to a foldable device for carrying and displaying at least one flat article wherein the foldable device, in a closed position, is approximately one quarter of the size of the device in an open position.

BACKGROUND ART

Numerous information management inventory systems are available for both commercial and private applications. These systems often take the form of calendars, to-do lists, telephone directories, and the like and may generally be either computer-based wherein the system is implemented by a computer program and accessed via a computer, or paper-based wherein the system comprises the recording of information in a formatted manner on paper. All of these systems endeavor to provide the user with an organized and structured mechanism for promptly accessing, recording, and displaying information.

Computer information management systems have become popular in recent years due to the ability of the systems to organize, display, and manipulate various types of information. These advantages are important with regard to the ability to change or modify data and information that is already recorded and the ability of the computer systems to handle large quantities of data. However, these computer information management systems also have the disadvantages of requiring access to a computer to both record or access the relevant information and also have the disadvantage of decreased portability, especially with mobile users.

Conversely, paper-based or manual information management systems have the portability that is desired by most users that are constantly away from the office or otherwise away from a computer system. Additionally, information can be easily and readily recorded and accessed by a user in a paper format without regard to accessing a computer to input or maintain data records.

Various patents are directed to types of paper-based organizers or pocket secretaries. For example, U.S. Pat. No. 4,296,945 shows a pocket secretary having pockets and a bracket for detachably mounting a notebook.

U.S. Pat. No. 4,470,620 shows a document holder for a writing pad, papers and accessories. The holder has covers and a leaf member hingedly positioned between the covers which may be used as a writing or organizing surface.

U.S. Pat. No. 4,519,629 shows a spiral notebook and folder construction formed from a single blank sheet of material. A pocket is provided on the inner surface of the front cover panel which opens outwardly.

U.S. Pat. No. 4,630,843 shows a binder for holding papers having an exterior coversheet and an overlying interior coversheet which is foldable to define a rigid panel separated by at least one flexible hinge panel. Pockets or sleeves may be included to hold writing instruments and a pocket sheet which may be translucent overlies the interior coversheet.

U.S. Pat. No. 4,964,656 shows a folder having a central panel and two side panels. The side panels have pockets to receive cards to assist telephone solicitors.

U.S. Pat. No. 5,333,908 discloses an information management system incorporating a means for binding computer printing paper in a notebook and a system for recording and organizing time and events in the notebook.

U.S. Pat. No. 5,494,366 is directed to an organizer notebook and having front and rear covers hingedly secured to one another wherein the inner surface of one of the covers has pockets for receipt and retention of personal items and the inner surface of the other cover has document retention means in the form of a pair of opposed flaps foldably secured to the cover beneath which papers and other documents can be placed in an organized manner.

U.S. Pat. No. 6,017,062 discloses a day planner for holding calendar pages, papers, notes, cards, etc., which includes a separate compartment for holding photographs.

U.S. Patent Application No. US2003/0209903 describes a planning or event organizer comprising dual rigid covers, onto which organizer components are detachably supported and wherein items such as a notebook and an expandable folder can be detachably contained within the covers of the organizer.

It can be seen that there are a wide variety of organizers, pocket secretaries, notebooks, and document holders that are adapted for storing and retaining papers and other personal items. Many of the prior art notebooks or organizers include provisions for the retainment of paper and documents, but in most cases, the paper must be specifically adapted to cooperate with a notebook. Additionally, a disadvantage of these prior art paper-based information management systems is that in general they are inflexible and that while they may display various papers in large format for easy readability, they are not able to be compacted sufficiently enough for ease of carrying and result in a device that is too bulky to fit into a purse, briefcase, or the like due to their thickness or size.

The present invention provides a simplified organizer for use by students, business persons, and for personal use which is convenient for travel, yet also provides for the full displaying of flat articles contained within the device. The foldable device of the present invention is intended to be used with whole sheets, which can easily be folded into quarter size. Therefore, when the binder is open, the printed material housed inside is of full-size printed material in order to give the user a full work surface to write on or to provide better readability. The foldable device can then be folded into a closed position so that the device and the printed material which it contains are only a quarter size of the opened size and can easily be stored into a purse, briefcase, or any other storage place for travel. Additionally, the organizer has retainer features for securing the printed material within the device such that the printed material may be variously sized.

SUMMARY

According to one embodiment, a foldable device for carrying and displaying at least one flat article is provided comprising a foldable unitary member adapted for movement between an open and a closed position and comprising an inside surface, an outside surface, and top, bottom, left and right side edges. The unitary member further comprises a latitudinal fold located between the top edge and the bottom edge for separating the unitary member into upper and lower portions and also comprises a longitudinal fold located between the left edge and the right side edge for separating the unitary member into left and right portions. The lower portion of the unitary member is folded onto the upper portion and the left portion is folded onto the right portion when the unitary member is in the closed position and the unitary member in such a closed position is approximately one quarter of the size of the unitary member in the open position. The foldable device further comprises at least one flat article retaining member located on the inside surface of the unitary member for releasably retaining the at least one flat article.

According to another embodiment, a foldable device for carrying and displaying at least one flat article is provided comprising a foldable unitary member as described above and further comprising a foldable liner member attached to the inside surface of the unitary member. The foldable liner comprises a latitudinal fold corresponding with the latitudinal fold of the unitary member, a longitudinal fold corresponding with the longitudinal fold of the unitary member, and a plurality of slits formed within the liner for releasably retaining the at least one flat article.

It is therefore an object to provide a foldable device for carrying and displaying at least one flat article wherein the device can display the contents of the flat article in full form when open and may be folded to a closed size that is approximately one quarter of the size of the device when open.

An object having been stated hereinabove, and which is achieved in whole or in part by the subject matter disclosed herein, other objects will become evident as the description proceeds when taken in connection with the accompanying drawings as best described hereinbelow.

DETAILED DESCRIPTION

Figure 1A:
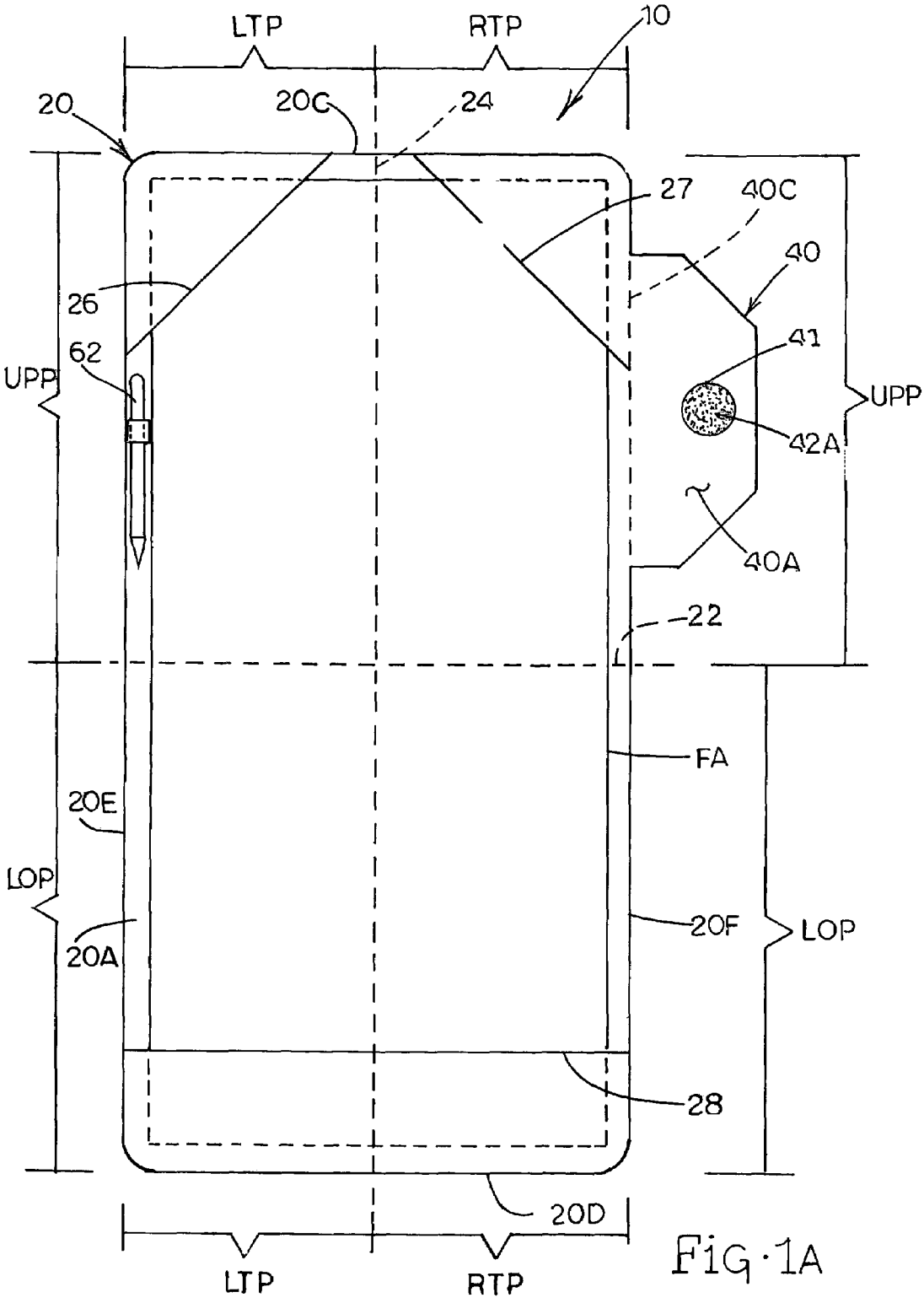
FIG. 1A is a front plan view of a foldable device provided in accordance with one embodiment of the present subject matter.
Figure 1B:
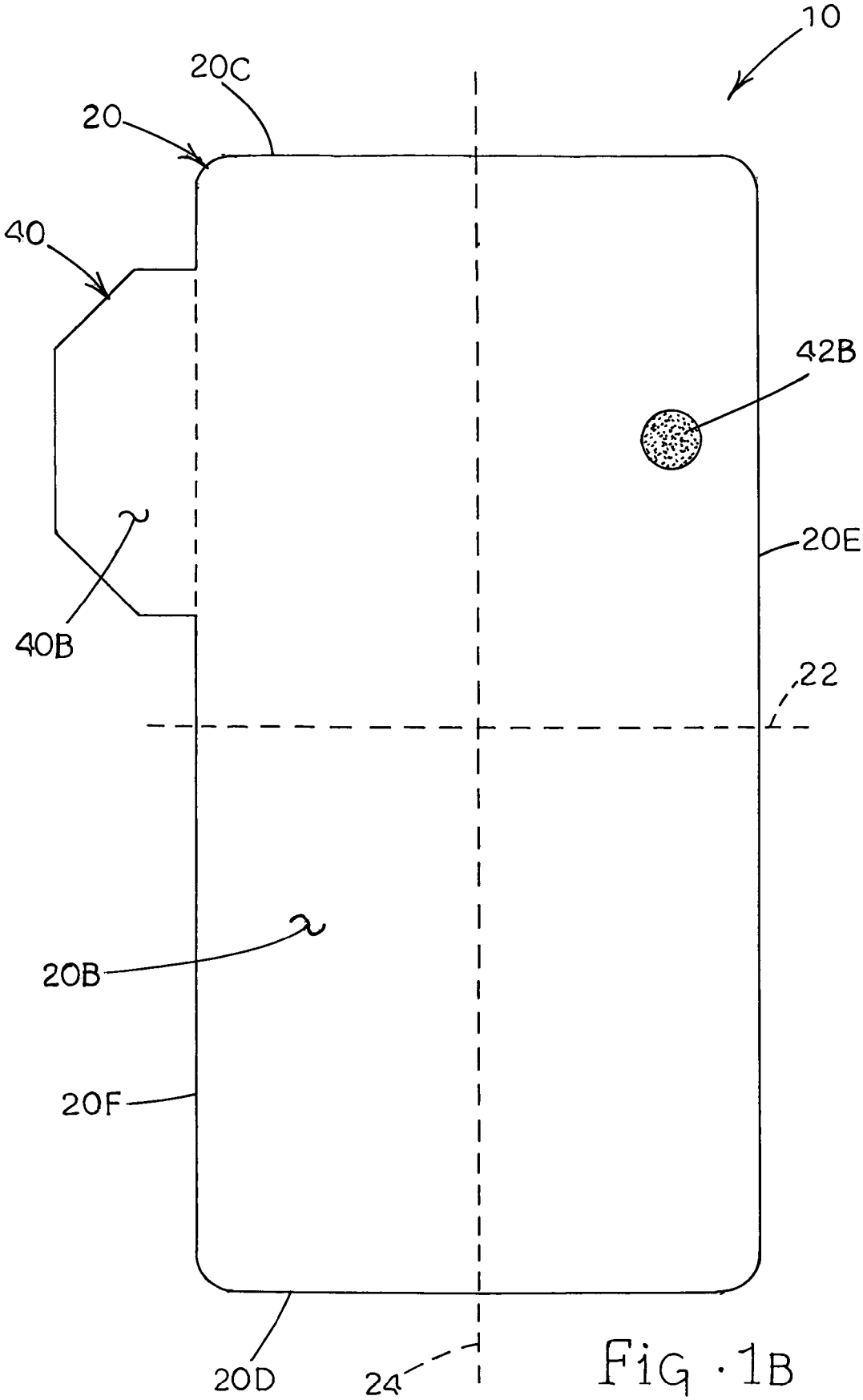
FIG. 1B is a rear plan view of a foldable device provided in accordance with one embodiment of the present subject matter.

Referring now to FIGS. 1A and 1B, an exemplary embodiment of the foldable device is shown generally as 10. Foldable device 10 is designed for carrying and displaying at least one flat article FA and comprises a foldable unitary member 20 that is adapted for movement between an open position and a closed position. Unitary member 20 comprises an inside surface 20A, outside surface 20B, top side edge 20C, bottom side edge 20D, left side edge 20E, and right side edge 20F and may be constructed of leather, cardstock, vinyl, urethane, aramid, nylon, cloth, paper or any other material known to those of skill in the art. It is understood that unitary member 20 may consist of a single parcel divided along folds (such as by scoring) or may consist of multiple parcels joined along folds (such as by binding), as is better described hereinbelow.

Unitary member 20 further comprises a latitudinal fold 22 located between top side edge 20C and bottom side edge 20D of unitary member 20, preferably equidistance between top side edge 20C and bottom side edge 20D. Latitudinal fold 22 separates unitary member 20 into upper portion UPP and lower portion LOP. Unitary member 20 also further comprises a longitudinal fold 24 located between left side edge 20E and right side edge 20F of unitary member 20, preferably equidistant between left side edge 20E and right side edge 20F. Longitudinal fold 24 separates unitary member 20 into left portion LTP and right portion RTP. Latitudinal fold 22 and longitudinal fold 24 may be formed in unitary member 20 through scoring, heating, binding, or any other method known to those of skill in the art for creating folds.

The preferable equidistant positioning of latitudinal fold 22 and longitudinal fold 24 allows for lower portion LOP to be folded onto upper portion UPP and left portion LTP to be folded onto right portion RTP when unitary member 20 is in the closed position. The placement of latitudinal fold 22 and longitudinal fold 24 allow unitary member 20 in the closed position to be approximately one quarter of the size of unitary member 20 when in the open position.

Foldable device 10 also comprises at least one flat article retaining member that is located on inside surface 20A of unitary member 20 for releaseably retaining at least one flat article FA. The flat article retaining member may comprise corner pockets such as left upper corner pocket 26 that is attached on inside surface 20A of unitary member 20 along left side edge 20E and top side edge 20C and right upper corner pocket 27 that is attached along right side edge 20F and top side edge 20C. The flat article retaining member may also comprise a single retaining pocket 28 that is shown as attached along left side edge 20E, bottom side edge 20D, and right side edge 20F. Flat article retaining members 26, 27, 28 may be constructed of any material known to those of skill in the art for releaseably retaining flat article FA within foldable device 10. So that the printed contents on the face of flat article FA may be seen from up underneath flat article retaining members 26, 27, 28, it is preferred that the flat article retaining members be constructed of clear polyvinyl or some other translucent material.

Figure 2:
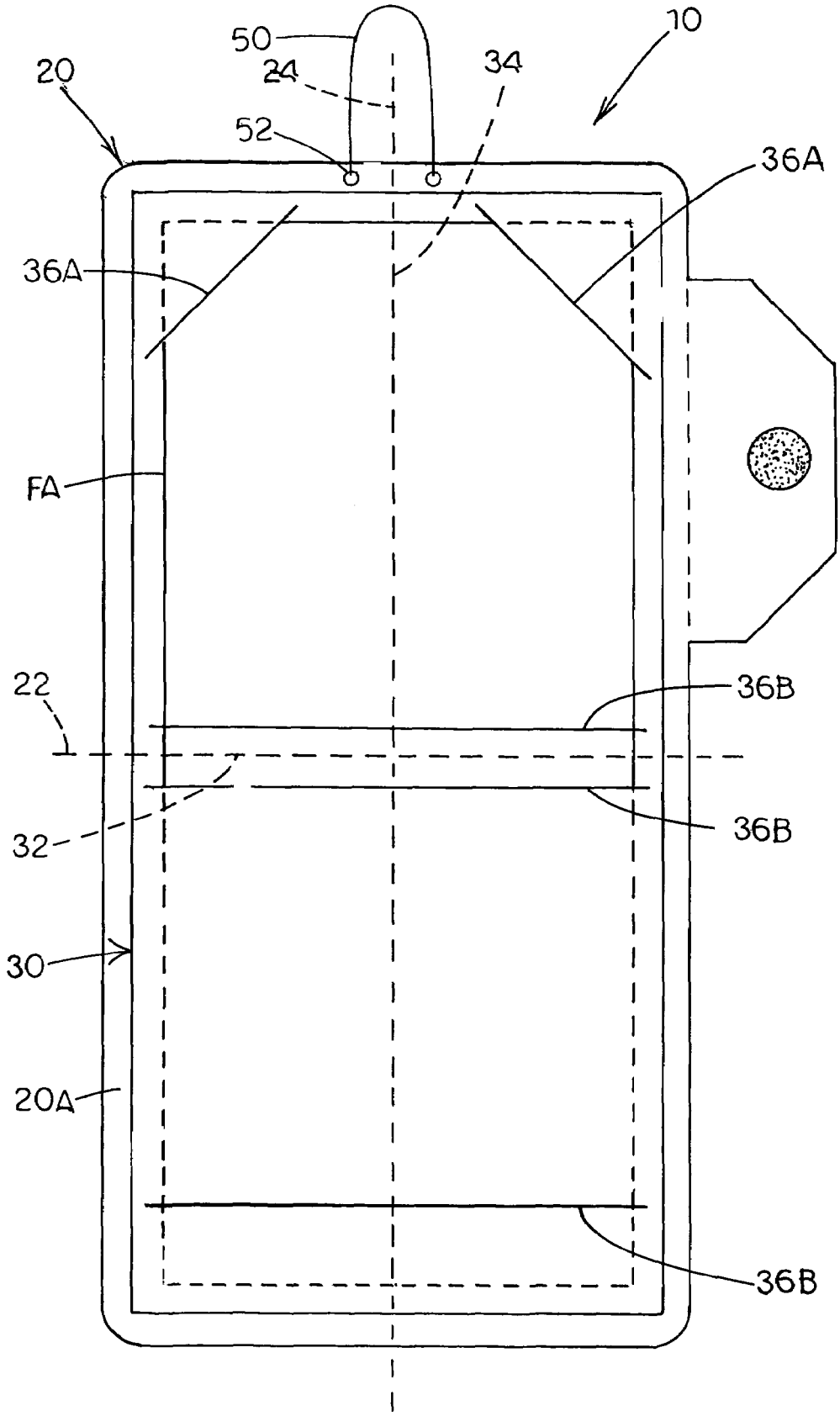
FIG. 2 is a front plan view of a foldable device provided in accordance with another embodiment of the present subject matter.

In another embodiment of the present subject matter as shown in FIG. 2, device 10 further comprises a foldable liner 30 that is attached to inside surface 20A of unitary member 20. Foldable liner 30 includes latitudinal fold 32 and longitudinal fold 34 that correspond with latitudinal fold 22 and longitudinal fold 24 of unitary member 20. Latitudinal fold 32 and longitudinal fold 34 of liner 30 allow liner 30 to be folded in conjunction with the folding action of unitary member 20. Foldable liner 30 further comprises a plurality of slits 36A and 36B that are formed within liner 30 for releaseably retaining flat article FA. As shown in FIG. 2, the upper corners of a flat article FA can be placed underneath upper slits 36A while the lower portion of the flat article FA may be placed under one of lower horizontal slits 36B for releaseably retaining the flat article (shown in FIG. 2 as being placed under the middle horizontal slit 36B). While liner 30 may be constructed of any material known to those of skill in the art, it is preferred that a translucent material such as clear polyvinyl be used so that any printed portions on flat article FA can be seen even when flat article FA is placed up underneath slits 36A and 36B.

Referring back to FIGS. 1A and 1B, foldable device 10 may further comprise a closure appendage 40 that is preferably attached to right side edge 20F and includes an inside surface 40A and an outside surface 40B. Closure appendage 40 is foldable along a fold line 40C at a point where closure appendage 40 attaches with right side edge 20F so that when unitary member 20 is folded into a closed position, closure appendage 40 holds unitary member 20 together in the folded arrangement.

In order for unitary member 20 and all contained flat articles FA to be held securely in a closed position by closure appendage 40, foldable device 10 may further comprise a closure element 41 for removably securing the device in a closed position. Closure element 41 may consist of hook and loop material, snap fasteners, magnets, buttons, clasps, or any other method of removably securing one surface to another surface. Referring to FIGS. 1A and 1B, closure element 41 may consist of hook and loop material wherein a first portion 42A is attached to inside surface 40A of closure appendage 40 and a second portion 42B is attached to outside surface 20B of unitary member 20. Closure element first portion 42A is interlockable with closure element second portion 42B such that when unitary member 20 is folded into a closed position and closure appendage 40 is folded over, first portion 42A and second portion 42B interlock so that unitary member 20 and contained flat article FA remain in a closed position.

Figures 3A, 3B, 3C:
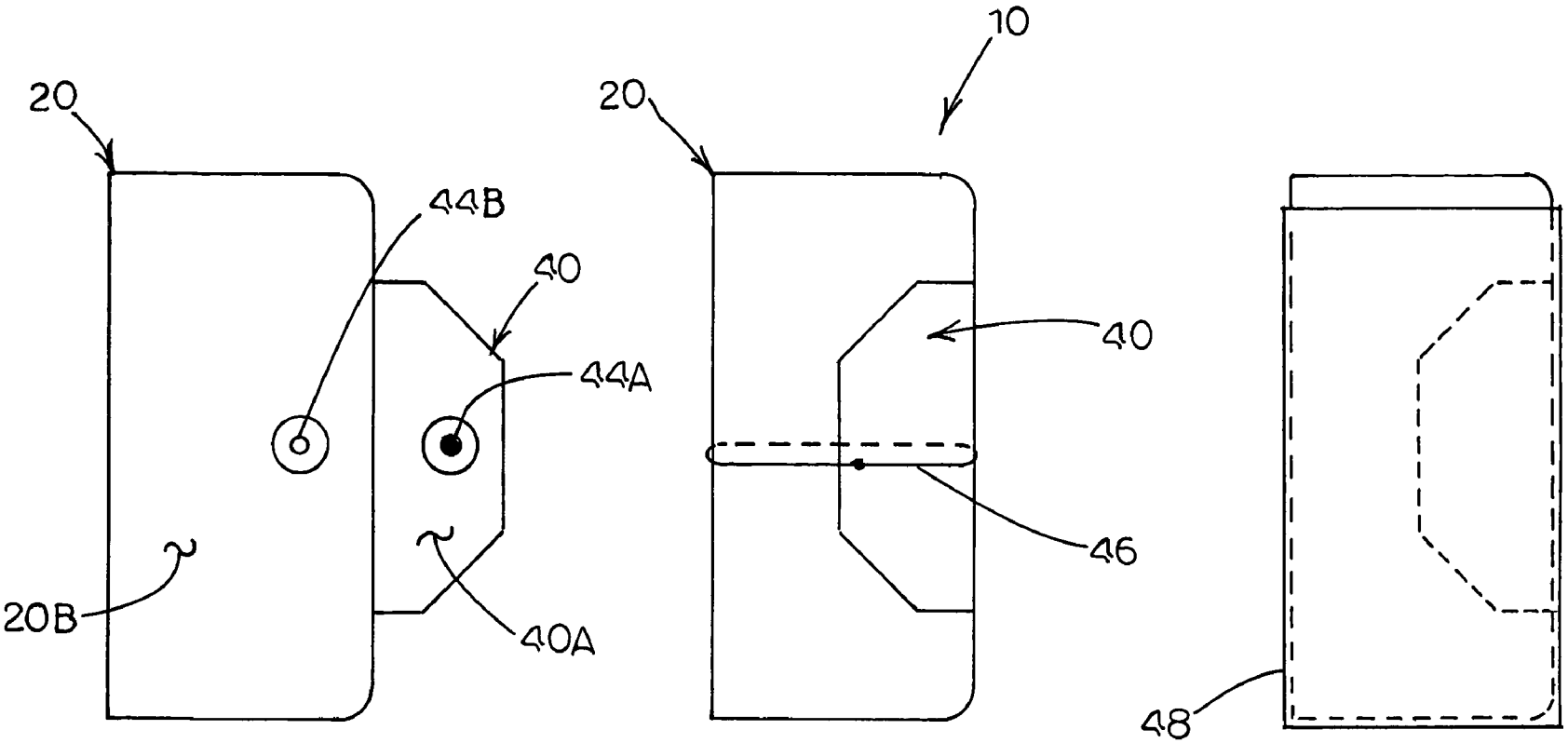
FIG. 3A-3C are plan views detailing various closure elements of a foldable device of the present subject matter.

Similarly, and as shown in FIG. 3A, closure element 41 may consist of a snap fastener stud and socket system wherein a first portion 44A is attached to inside surface 40A of closure appendage 40 and is interlockable with a second portion 44B that is attached to outside surface 20B of unitary member 20.

Referring to FIG. 3B, a further example of closure element 41 is shown and comprises a strap 46 that extends from closure appendage 40 and that encircles foldable device 10 when the device is in a closed position. Closure strap 46 may be constructed of elastic material, string, or any other material known to those of skill in the art.

Referring now to FIG. 3C, it is also envisioned that closure element 41 may comprise an openable sleeve 48 that encircles foldable device 10 in a closed position. It is envisioned that the use of sleeve 48 would entail that foldable device 10 be folded completely into a closed position and then placed within the open end of sleeve 48 so that the sleeve contains device 10 in a closed position. While closure appendage 40 is shown on foldable device 10 within sleeve 48 in FIG. 3C, it is envisioned that closure appendage 40 may not be warranted on this embodiment and may not be present on the device.

One advantage of the present subject matter is the ability to maintain an expanded and readable flat article within a device that can be readily folded into a compact device for storage and travel. When foldable device 10 is in an open position so that flat article FA may be displayed completely, it may be desired to attach the device to an external structural surface, such as a wall, in the open position. To accomplish this, foldable device 10 may further comprise an attachment element 50 that may be secured between an external structural surface (not shown) and unitary member 20. It is envisioned that attachment element 50 may comprise the use of string, fabric, leather-like material, or the like and may be fed through rivets 52, holes, or slits, or equivalent openings within unitary member 20 in order to place foldable device 10 in a hanging, open position.

It is envisioned that the type of flat articles FA to be carried within foldable device 10 may consist of any organizer type articles known to those of skill in the art. This may include, but is not limited to, calendars, appointment lists, to-do lists, address book contact pages, expense reports, journal pages, event pages, recipes, credit cards, and coupons. Flat articles FA may also consist of laminated articles, parchment paper, cardstock, or the like. The user may carry one or more flat articles, depending on their usage pattern and desire to maintain a minimal thickness of the closed device. Additionally, foldable device 10 may comprise a writing instrument 62 that is detachably connected to inside surface 20A of unitary member 20. Writing instrument 62 may comprise a pen, pencil, or any other writing instrument and provides a mechanism for writing on various flat articles that are carried within the device.

Figure 4B:
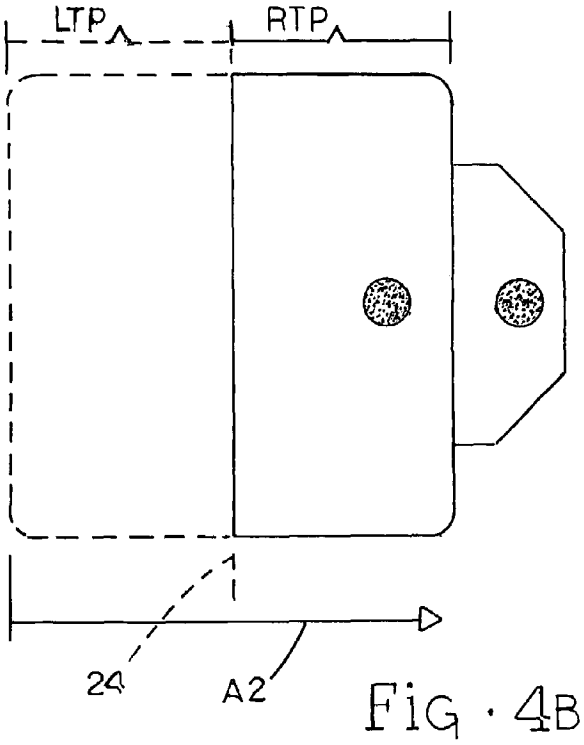
FIGS. 4A-4D are plan views showing operation of a foldable device of the present subject matter between a fully open position and a fully closed position.
Figure 4A:
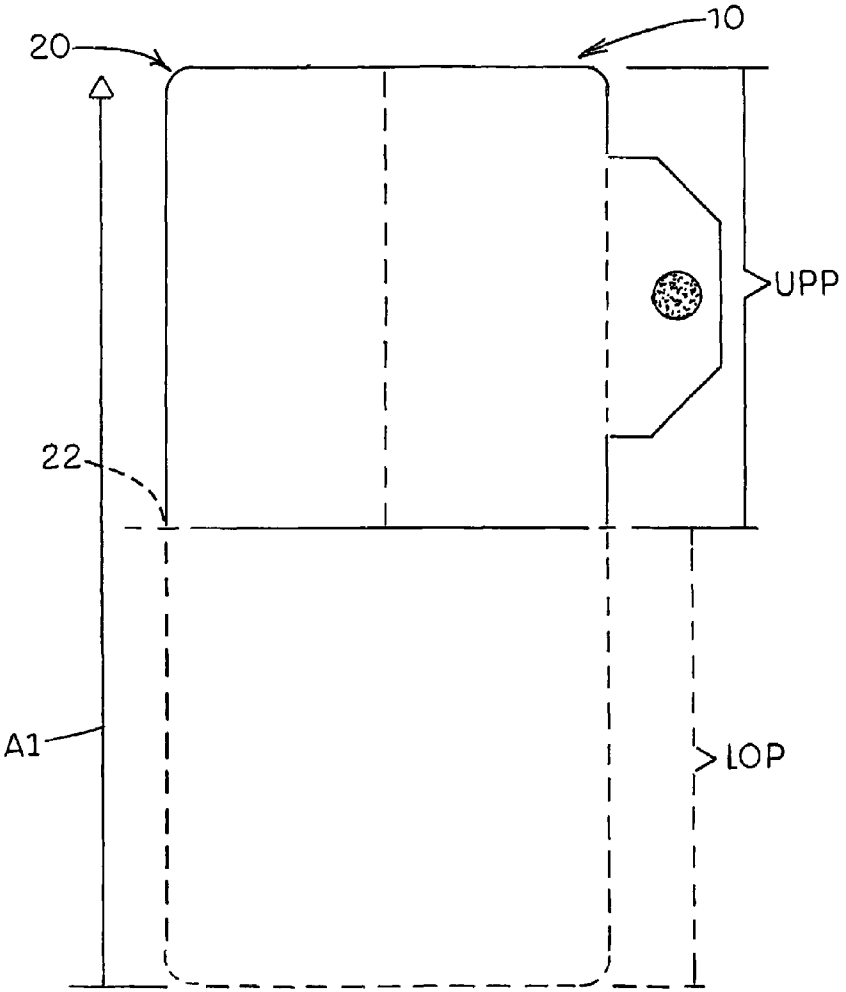
Figure 4D:
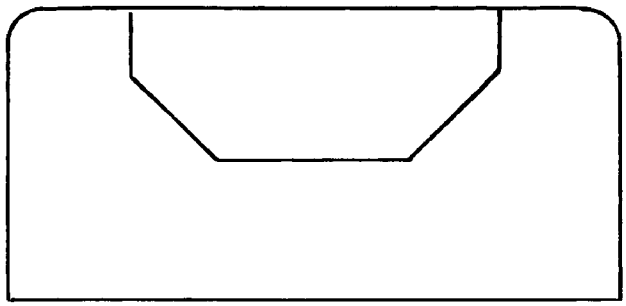
Figure 4C:
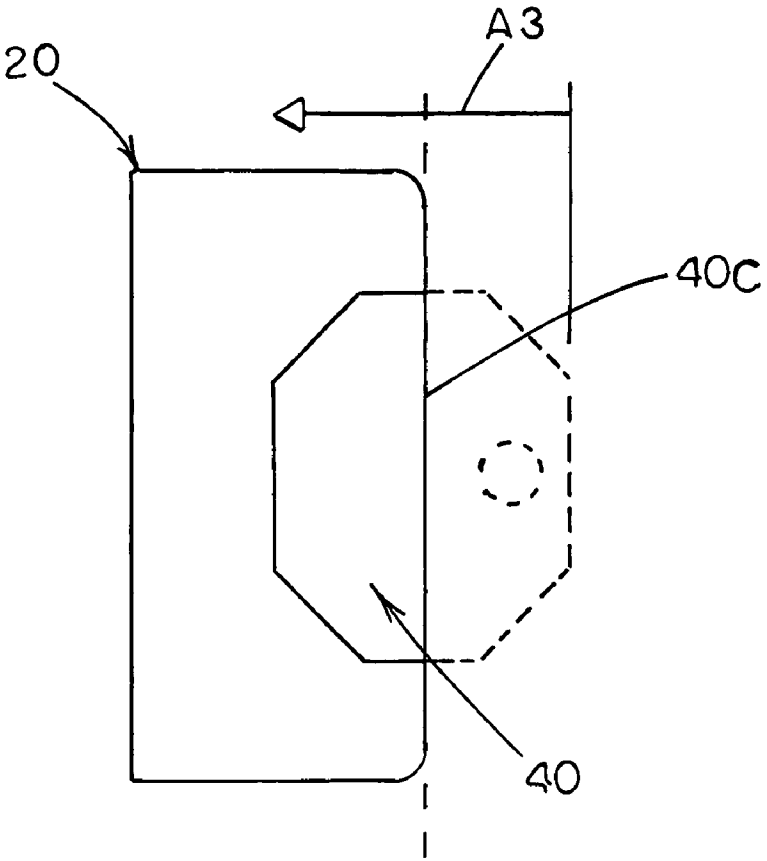

Referring now to FIGS. 4A-4D, the closing operation of foldable device 10 will now be discussed. The initial folding action as shown in FIG. 4A includes the movement of unitary member lower portion LOP along latitudinal fold line 22 in the direction of arrow A1. This movement allows unitary member lower portion LOP to be folded onto unitary member upper portion UPP as shown. Next, and as shown in FIG. 4B, unitary member left portion LTP is folded along longitudinal line 24 in the direction shown by arrow A2. This movement allows unitary member left portion LTP to be folded onto unitary member right portion RTP so that folded device 10 is now in a closed position that is approximately one quarter of the size of the device when it is in the open position. As shown in FIGS. 4C and 4D, to secure the device into the closed position, closure appendage 40 is moved along fold line 40C in the direction of arrow A3. At this point, a closure element may be used to removably secure the device into the completely closed position so that the device is ready for travel.

When it is desired to open the foldable device for viewing and/or hanging, the above procedures are simply reversed so that the device expands from a folded, compact size to a larger readable size.

It is envisioned that additional accessories may be added to foldable device 10 in order to allow the end user to personalize the device for their own use. These additional accessories may include clips or wires that hold together paper for additional writing surfaces or that holds storage devices such as vinyl zippered pouches. These clips may be inserted into tabs or slits in various locations within foldable device 10 so that the additional paper or storage pouches may be flipped to the back of foldable device 10 during various stages of use.

Additionally, a folder, envelope, or other container may be included to hold extra papers and other items that are not being contained or used within the binder, but may be desired to be carried along with the binder. It is also envisioned that slits or cutouts may be formed within foldable device 10 for the storage of additional items such as spare calendar pages and coupons. Finally, personalized touches may be added to outside surface 20B of unitary member 20, such as sports logos, college logos, or corporation markings.

It will be understood that various details of the present subject matter may be changed without departing from the scope of the present subject matter. Furthermore, the foregoing description is for the purpose of illustration only, and not for the purpose of limitation, as the present subject matter is defined by the claims as set forth hereinafter.

What is claimed is:

1. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article; and (c) wherein the foldable unitary member is configured for receiving the at least one flat article in a position where the flat article extends across at least one of the latitudinal or longitudinal folds of the unitary member.

2. The foldable device according to claim 1 wherein the unitary member is constructed of a material selected from the group consisting of leather, cardstock, vinyl, urethane, aramid, nylon, cloth, and paper.

3. The foldable device according to claim 1 wherein the latitudinal fold is located approximately equidistance between the top side edge and the bottom side edge.

4. The foldable device according to claim 1 wherein the longitudinal fold is located approximately equidistance between the left side edge and the right side edge.

5. The foldable device according to claim 1 wherein the at least one flat article retaining member comprises a translucent material.

6. The foldable device according to claim 5 wherein the translucent material is clear polyvinyl.

7. The foldable device according to claim 1 wherein the at least one flat article retaining member comprises at least one pocket.

8. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article; and (c) wherein the at least one flat article retaining member comprises a left upper corner pocket attached along the left and top side edges, a right upper corner pocket attached along the right and top side edges, and a single retaining pocket attached along the left, bottom, and right side edges.

9. The foldable device according to claim 1 further comprising a closure appendage attached to one of the left or right side edges of the unitary member and including an inside surface and an outside surface.

10. The foldable device according to claim 9 further comprising a closure element for removeably securing the unitary member in a closed position.

11. The foldable device according to claim 10 wherein the closure element is selected from the group consisting of hook and loop material, snap fasteners, magnets, buttons, and clasps.

12. The foldable device according to claim 11 wherein the hook and loop material comprises a first portion attached to the inside surface of the closure appendage and a second portion attached to the outside surface of the unitary member and interlockable with the first portion.

13. The foldable device according to claim 11 wherein the snap fastener comprises a snap fastener stud and socket system comprising a first portion attached to the inside surface of the closure appendage and a second portion attached to the outside surface of the unitary member and interlockable with the first portion.

14. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article;

(c) a closure appendage attached to one of the left or right side edges of the unitary member and including an inside surface and an outside surface; and (d) a closure element for removeably securing the unitary member in a closed position, wherein the closure element comprises a strap extending from the closure appendage and further wherein the strap encircles the unitary member in a closed position.

15. The foldable device according to claim 14 wherein the strap is elastic.

16. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article;

(c) a closure appendage attached to one of the left or right side edges of the unitary member and including an inside surface and an outside surface; and (d) a closure element for removeably securing the unitary member in a closed position, wherein the closure element comprises a sleeve that encircles the unitary member in a closed position.

17. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article; and (c) an attachment element secured to the unitary member for attaching the device to a structural surface in the open position.

18. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position;

(b) at least one flat article retaining member located on the inside surface of the unitary member for releasably retaining the at least one flat article; and (c) a writing instrument detachably connected to the inside surface of the unitary member.

19. A foldable device for carrying and displaying at least one flat article comprising:

(a) a foldable unitary member adapted for movement between an open and a closed position, the unitary member comprising an inside surface, an outside surface, and top, bottom, left and right side edges and further comprising:

(i) a latitudinal fold located between the top side edge and the bottom side edge for separating the unitary member into upper and lower portions;

(ii) a longitudinal fold located between the left side edge and the right side edge for separating the unitary member into left and right portions; and (iii) wherein the lower portion of the unitary member is folded onto the upper portion and the left portion is folded onto the right portion when the unitary member is in the closed position and further wherein the unitary member in the closed position is approximately one quarter of a size of the unitary member in the open position; and (b) a foldable liner member attached to the inside surface of the unitary member comprising:

(i) a latitudinal fold corresponding with the latitudinal fold of the unitary member;

(ii) a longitudinal fold corresponding with the longitudinal fold of the unitary member; and (iii) a plurality of slits formed within the liner for releasably retaining the at least one flat article.

20. The foldable device according to claim 19 wherein the unitary member is constructed of a material selected from the group consisting of leather, cardstock, vinyl, urethane, aramid, nylon, cloth, and paper.

21. The foldable device according to claim 19 wherein the latitudinal fold of the unitary member is located approximately equidistance between the top side edge and the bottom side edge.

22. The foldable device according to claim 19 wherein the longitudinal fold of the unitary member is located approximately equidistance between the left side edge and the right side edge.

23. The foldable device according to claim 19 wherein the foldable liner member comprises a translucent material.

24. The foldable device according to claim 23 wherein the translucent material is clear polyvinyl.

25. The foldable device according to claim 19 further comprising a closure appendage attached to one of the left or right side edges of the unitary member and including an inside surface and an outside surface.

26. The foldable device according to claim 25 further comprising a closure element for removeably securing the unitary member in a closed position.

27. The foldable device according to claim 26 wherein the closure element is selected from the group consisting of hook and loop material, snap fasteners, magnets, buttons, and clasps.

28. The foldable device according to claim 27 wherein the hook and loop material comprises a first portion attached to the inside surface of the closure appendage and a second portion attached to the outside surface of the unitary member and interlockable with the first portion.

29. The foldable device according to claim 27 wherein the snap fastener comprises a snap fastener stud and socket system comprising a first portion attached to the inside surface of the closure appendage and a second portion attached to the outside surface of the unitary member and interlockable with the first portion.

30. The foldable device according to claim 26 wherein the closure element comprises a strap extending from the closure appendage and further wherein the strap encircles the unitary member in a closed position.

31. The foldable device according to claim 30 wherein the strap is elastic.

32. The foldable device according to claim 26 wherein the closure element comprises a sleeve that encircles the unitary member in a closed position.

33. The foldable device according to claim 19 further comprising an attachment element secured to the unitary member for attaching the device to a structural surface in the open position.

34. The foldable device according to claim 19 further comprising a writing instrument detachably connected to the inside surface of the unitary member.

* * * * *